US012618296B1

(12) United States Patent
McManus et al.

(10) Patent No.: US 12,618,296 B1
(45) Date of Patent: May 5, 2026

(54) PREVENTING LOSS OF HYDROCARBON WELL CONVEYANCE STRING UPON UNINTENDED CONNECTOR DECOUPLING

(71) Applicant: Halliburton Energy Services, Inc., Houston, TX (US)

(72) Inventors: David McManus, Tulsa, OK (US); Daniel Steven McWherter, Tulsa, OK (US); Ankit Kansagra, Vadodara (IN); Neudis Enrique Sáez, Quito (EC); Grant Walker Buchman, Tulsa, OK (US); Joshua Wayne Webster, Jenks, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/172,191

(22) Filed: Apr. 7, 2025

(51) Int. Cl.
*E21B 17/06* (2006.01)
*E21B 17/046* (2006.01)
*E21B 47/12* (2012.01)

(52) U.S. Cl.
CPC ..... *E21B 17/06* (2013.01); *E21B 17/046* (2013.01); *E21B 47/12* (2013.01)

(58) Field of Classification Search
CPC ..... E21B 17/07; E21B 17/076; E21B 17/06; E21B 17/046; E21B 17/04;
(Continued)

(56) References Cited

U.S. PATENT DOCUMENTS 3,608,932 A * 9/1971 Brown ..... E21B 33/038 285/912
11,639,761 B2 * 5/2023 Snyder, II ..... F16L 27/0828 29/525.01

(Continued)

FOREIGN PATENT DOCUMENTS

WO 2011104629 A1 9/2011

OTHER PUBLICATIONS

Halliburton Energy Services, Inc., unpublished U.S. Appl. No. 18/753,067, filed Jun. 25, 2024, titled "Improved Coupling Member for Use With a Connection"—stored in the USPTO Image File Wrapper System (IFW). In accordance with the Waiver of the Copy Requirements in 37 CFR 1.98 for Cited Pending U.S. Patent Applications, 1287 O.G. 163 (Oct. 19, 2004), unpublished U.S. Patent Application is available in the IFW and, therefore, not provided.

(Continued)

*Primary Examiner* — Yanick A Akaragwe
(74) *Attorney, Agent, or Firm* — Kilpatrick Townsend & Stockton, LLP

(57) ABSTRACT

A coupling device is installable to a connector of a hydrocarbon well tubing string to prevent a downhole loss of a portion of the tubing string upon an unintended decoupling of the connector. The connector may include an uphole component and a downhole component with a joint therebetween. The coupling device may at least partially encircle the connector while spanning the joint. A first flange can protrude radially inwardly from the coupling device to (Continued)

engage a groove in the downhole component and a second flange may protrude radially inwardly from the coupling device to extend into a recess in the uphole component. The coupling device limits the downhole movement of the downhole component of the connector and the portion of the tubing string coupled thereto upon an unintended decoupling of the connector by way of a restricted axial movement of the second flange within the recess in the uphole component.

20 Claims, 8 Drawing Sheets

(58) Field of Classification Search
CPC ..... E21B 17/0465; E21B 17/042; E21B 17/0423; E21B 17/0426

See application file for complete search history.

(56) References Cited

U.S. PATENT DOCUMENTS

| | | | | |
|---|---|---|---|---|
| 2013/0157767 | A1 | 6/2013 | Slack | |
| 2015/0130185 | A1* | 5/2015 | Knapp | F16L 19/0231 285/330 |
| 2015/0322730 | A1 | 11/2015 | Gallagher | |
| 2016/0032664 | A1 | 2/2016 | Greening et al. | |
| 2021/0372527 | A1* | 12/2021 | Fripp | E21B 17/042 |
| 2022/0268108 | A1* | 8/2022 | Allen | E21B 17/042 |
| 2023/0265723 | A1* | 8/2023 | Galle | E21B 17/085 285/330 |
| 2023/0296006 | A1 | 9/2023 | Nowitzki et al. | |

OTHER PUBLICATIONS

International Patent Application No. PCT/US2025/024920, International Search Report and Written Opinion mailed Jan. 6, 2026, 11 pages.

* cited by examiner

PREVENTING LOSS OF HYDROCARBON WELL CONVEYANCE STRING UPON UNINTENDED CONNECTOR DECOUPLING

TECHNICAL FIELD

The present disclosure relates generally to hydrocarbon well operations, and more particularly although not necessarily exclusively, to a coupling device to prevent downhole loss of a hydrocarbon well conveyance string upon an unintended decoupling of a conveyance string component connector.

BACKGROUND

In hydrocarbon well operations, completion operations may follow the drilling of a wellbore. The completion operations may include casing the wellbore and placing various completion equipment downhole in the wellbore. This equipment may include, for example, conveyance (e.g., production) tubing, and various components and devices that are coupled thereto. The various components and devices may include, in some examples, pumping equipment such as an electric submersible pump (ESP) assembly of an artificial lift system. The ESP assembly may include, among other components, a pump, a sealing section, an intake section, and a motor. Each of these components, as well as various other downhole components, can be coupled to the conveyance tubing. Connectors may be used for this purpose. Such connectors occasionally fail. For example, when a connector is a flanged connector, the fasteners securing an upper portion to a lower portion of the flanged connector may break. When a connector fails, a portion of the conveyance tubing string located below the break point of the connector may fall downhole into the wellbore.

DETAILED DESCRIPTION

Figure 1:
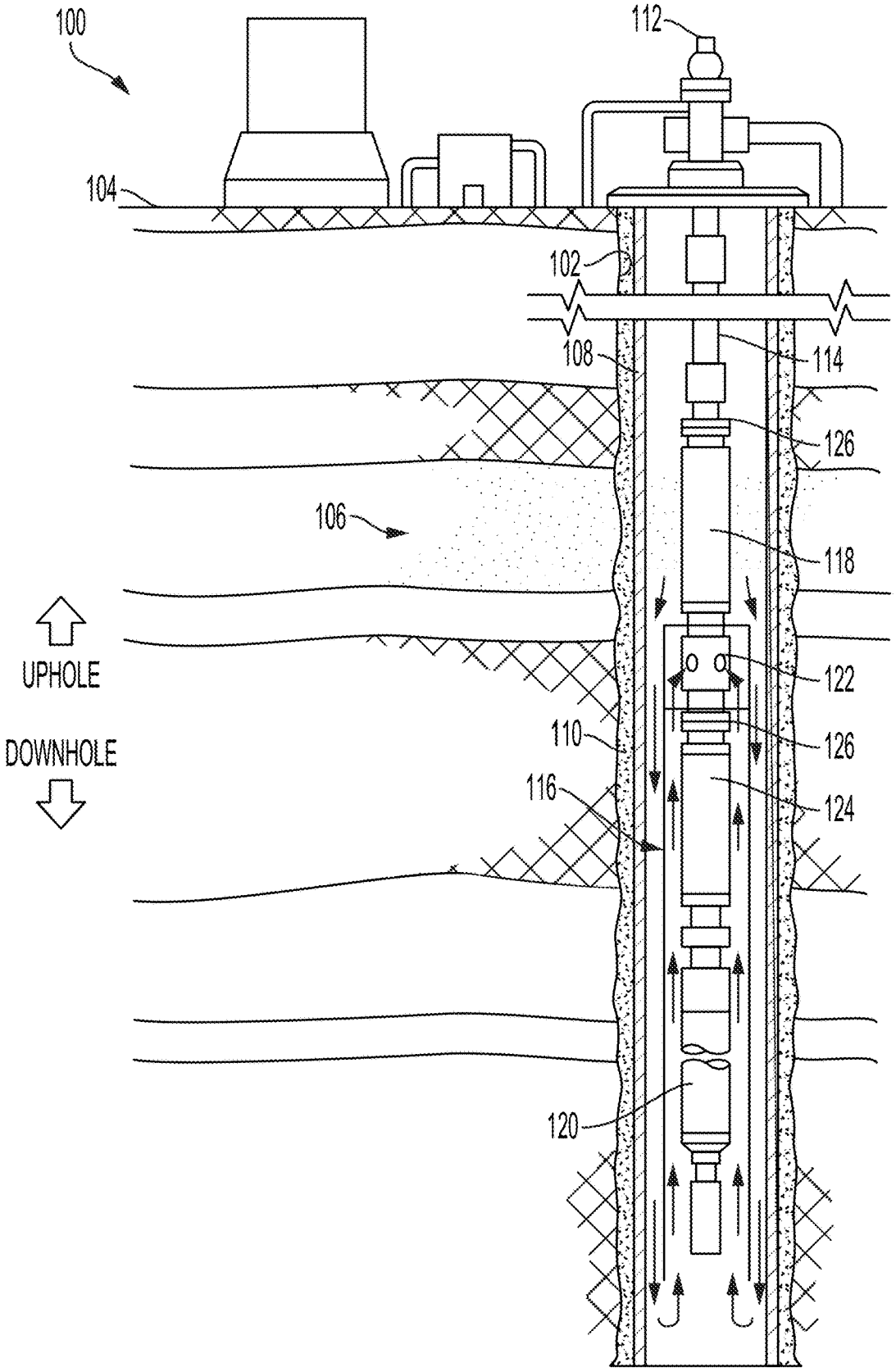
FIG. 1 is a schematic diagram of a completed hydrocarbon well according to one example of the present disclosure.

Certain aspects and examples of the present disclosure relate to a coupling device that can be installed to a connector of a hydrocarbon well conveyance tubing string to prevent loss of a downhole portion of the tubing string upon an unintended decoupling of the connector. In some examples, the conveyance tubing string may be a production tubing string that is installed in a completed wellbore to conduct hydrocarbon well fluids extracted from a formation surrounding the wellbore to a surface of the well, such as to a wellhead.

In some examples, the connector may be used to couple components of different downhole equipment to the conveyance tubing string. For example, a connector may be used to couple components of a pump assembly of an artificial lift system to the conveyance tubing string. In such an example, the connector may include a base member and a head member.

A connector according to the present disclosure may include an uphole component and a downhole component having a joint therebetween. In some examples, the connector may be a flanged connector, where the uphole component and the downhole component are secured to one another using threaded fasteners. In other examples, the connector may instead be a head-to-head connector, a base-to-base connector, a threaded connector, etc. A sealing element may be associated with the connector to seal the joint between the uphole component and the downhole component and to thereby prevent a leakage of well fluid through the connector. In some examples, the sealing element may be an O-ring. In other examples, the sealing element may be a metal-to-metal seal, or another sealing mechanism.

The coupling device may include a sleeve member. The sleeve member can encircle or partially encircle the connector and to span the joint between the uphole component and the downhole component of the connector. In some examples, the sleeve member may be a split sleeve member comprising two halves that can each be installed over a respective portion of the connector and subsequently secured to one another.

The sleeve member can include a first flange that protrudes radially inwardly from the inside wall of the sleeve member and is arranged to engage a groove in one of the downhole component or the uphole component of the connector when the sleeve member is installed thereto. The sleeve member can also include a second flange that protrudes radially inwardly from an inside wall of the sleeve member and is arranged on the sleeve member to extend into a recess in the uphole component or the downhole component of the connector when the sleeve member is installed thereto. In at least an example where the groove and the recess are equally spaced regardless of which is located in the uphole or the downhole component of the connector, the orientation of the sleeve member may be reversible so that the sleeve is usable in either case by enabling the first flange to engage with the groove in one of the uphole component or downhole component and the second flange to engage with the recess in the other of the uphole component or downhole component.

In some examples, the recess may be inherently present in the uphole component or the downhole component. In other examples, the recess may be added to (e.g., machined into) the uphole component or the downhole component. A thickness of the second flange of the sleeve member is selected to be less than an axial dimension of the recess, which allows the second flange to move axially (i.e., in an uphole and downhole direction) by some limited distance within the recess. In some examples, the groove may be inherently present in the downhole component or the uphole component. In other examples, the groove may be added to (e.g., machined into) the downhole component or the uphole component.

Upon an unintended decoupling of the connector of a deployed conveyance tubing string, the downhole component of the connector and a portion of the conveyance tubing string coupled thereto may move in a downhole direction. In examples where the recess is located in the uphole component and the groove is located in the downhole component, this may cause a like downhole movement of the coupling device due to the engagement of the first flange of the sleeve member with the groove in the downhole component. The second flange of the sleeve member may consequently move in a downhole direction within the recess in the uphole component until it reaches a hard stopped position at or near a terminus of the recess. For example, the second flange may move in a downhole direction within the recess until a downhole face of the second flange contacts the head of a flange bolt, a bottom wall of the recess (e.g., an uphole face of the connector flange), or another element that acts as a hard stop to further downhole movement of the second flange. This hard stoppage of further downhole movement of the second flange also prevents further downhole movement of the coupling device, as well as the downhole component and the portion of the conveyance tubing string coupled thereto.

In examples where the groove is located in the uphole component and the recess is located in the downhole component, engagement of the first flange of the sleeve member with the groove in the uphole component can cause the coupling device to remain stationary while the downhole component of the connector moves downhole within the coupling device upon an unintended decoupling of the connector of a deployed conveyance tubing string. For example, the downhole component of the connector may move downhole within the sleeve member until it reaches a hard stopped position. In some examples, the downhole component may move in a downhole direction within the sleeve member until a downhole face of a flange or another element of the downhole component contacts an uphole face of the second flange of the sleeve member. This hard stoppage of downhole movement of the downhole component can also prevent any further downhole movement of the portion of the conveyance tubing string coupled thereto.

Use of a coupling device according to the present disclosure can thus prevent conveyance tubing string loss upon the unintended decoupling of a connector. Further, allowing the downhole component to separate and move axially away from the uphole component by a limited distance upon an unintended decoupling of the connector can allow well fluids present within the tubing string to drain into the well annulus. Drainage of the well fluid can reduce pressure within the conveyance string and can also substantially reduce the weight of the tubing string, which facilitates retrieval of the tubing string to the well surface in order to repair or replace the connector. In some examples, well fluid can drain from the tubing string into the well annulus through a gap between the inside wall of the sleeve member and an outside surface of the connector. In other examples, one or more fluid passageways may extend from the inside wall through an outside wall of the sleeve member and may instead or also act as pathways through which well fluid can drain from the tubing string into the well annulus.

Use of a coupling device according to the present disclosure can eliminate or reduce the costs typically resulting from an unintended decoupling of a conveyance tubing string connector. For example, use of a coupling device according to the present disclosure can eliminate the often significant costs resulting from one or more of an operation to retrieve a tubing string that has separated and fallen downhole, lost production time, damage to components of the fallen tubing string, and/or damage to the wellbore, a wellbore casing, or other downhole well equipment resulting from the fallen tubing string.

Illustrative examples follow and are given to introduce the reader to the general subject matter discussed herein rather than to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 schematically depicts one example of a completed hydrocarbon well 100 according to one example of the present disclosure. The hydrocarbon well 100 includes a wellbore 102 that extends from a well (ground) surface 104 into a subterranean formation 106. The subterranean formation 106 may include a reservoir from which hydrocarbon fluids (e.g., oil or gas) may be recovered. In other examples, the hydrocarbon well 100 may instead be drilled into the floor beneath a body of water, such as an ocean floor or a floor of a body of fresh water.

In this example, the wellbore 102 of the hydrocarbon well 100 is depicted as being entirely vertical. In other examples, one or more portions of the wellbore 102 may also be horizontal, deviated at other angles, or curved. In this example, the hydrocarbon well 100 includes a wellbore casing 108, which may be cemented into the wellbore 102 by introducing cement 110 into an annular space between the wall of the wellbore 102 and the wellbore casing 108. In other examples, all or a portion of the wellbore 102 may be uncased or only partially cased.

The hydrocarbon well 100 can additionally include a wellhead 112, which can be positioned at the well surface 104 as shown. Hydrocarbons extracted from the reservoir through the wellbore 102 may be conveyed to the wellhead 112 at the well surface 104 by way of a downhole conveyance. In this example, the downhole conveyance is a production tubing string 114 that extends from the wellhead 112 into the wellbore 102 in the subterranean formation 106. When the wellbore 102 includes one or more horizontal or other non-vertical portions, the production tubing string 114 may also extend through those portions of the wellbore 102. The production tubing string 114 may comprise, for example, multiple individual sections of connected hollow pipe. Consecutive sections of the hollow pipe may be releasably connected end-to-end, such as by threaded connection between the pipe sections.

The production tubing string 114 can include other components in addition to the pipe sections. In this example, the production tubing string 114 includes an artificial lift system that includes a pump assembly 116 for raising hydrocarbon fluids from downhole in the wellbore 102 up to the wellhead 112 at the well surface 104. The pump assembly 116 may be one of multiple pump assemblies. The pump 118 of the pump assembly 116 may be, for example, an electric submersible pump. The pump assembly 116 can also include a motive device for operating the pump 118. In this example, the motive device may be, for example, an electric motor 120 or any of various other devices that can generate the rotary motion necessary to operate the pump 118 and can function in a hydrocarbon well environment. The pump assembly 116 may further include, for example, intake ports 122 for drawing hydrocarbon fluid from within the wellbore 102 into the production tubing string 114, and a seal section 124 that may carry a thrust of the pump 118 and equalize pressure to the electric motor 120.

It is possible for component connectors of the production tubing string 114 to fail. For example, head-to-head connectors, base-to-base connectors, and threaded connectors associated with the pump 118, the seal section 124, or one or more other production tubing string 114 components may fail. As shown in FIG. 1, components such as the pump 118, the seal section 124, and other components of the production tubing string 114, may utilize flanged connectors 126 in some examples. A flanged connector 126 may include, for example, an uphole component that is coupled to a downhole component by one or more fasteners, such as a plurality of threaded fasteners (e.g., bolts). Flanged connectors, such as the flanged connector 126 may also fail. For example, the threaded fasteners of the flanged connector 126 may break.

Regardless of the particular connector type, when an unintended decoupling of a connector occurs, the portion of the production tubing string 114 located downhole of the decoupling point can separate from the portion of the production tubing string 114 located uphole of the decoupling point and fall deeper into the wellbore 102. The fallen portion of the production tubing string 114 can damage the casing 108 or wellbore wall of the hydrocarbon well 100, or other equipment within the wellbore 102. Components (e.g., artificial lift components) coupled to the fallen portion of the production tubing string 114 can also be damaged. Additionally, retrieval of the fallen portion of the production tubing string 114 can be difficult, time consuming, and costly.

Figure 2:
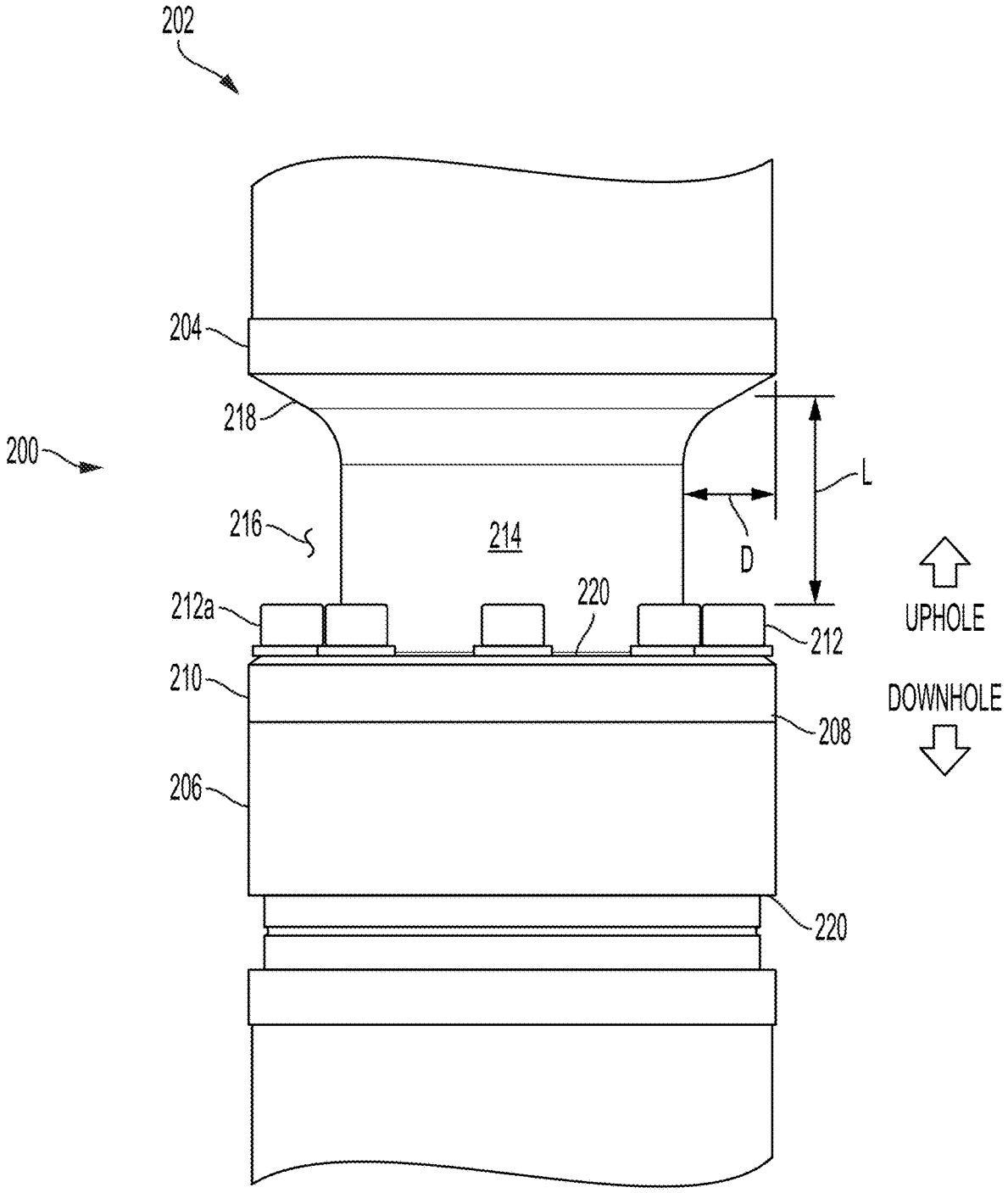
FIG. 2 is an enlarged view of a flanged connector of a conveyance tubing string located within a wellbore of a hydrocarbon well according to one example of the present disclosure.

FIG. 2 is an enlarged view of a flanged connector 200 of a conveyance tubing string 202 located within a wellbore of a hydrocarbon well (e.g., hydrocarbon well 100 of FIG. 1) according to one example of the present disclosure. In other examples, the connector may instead be a head-to-head connector, a base-to-base connector, a threaded connector, etc. The flanged connector 200, or another conveyance tubing string 202 connector, can be used to couple components of different downhole equipment to the conveyance tubing string 202. In some examples, the flanged connector 200 may be used to couple components of an artificial lift system to the conveyance tubing string. For example, the flanged connector 200 may be used to couple a bolt-on discharge to a pump, a pump to another pump, a pump to an intake, a pump to a gas separator, a pump intake to a seal, a gas separator to a seal, a seal to a motor, etc.

The flanged connector 200 of this example includes an uphole component 204 and a downhole component 206, which may be placed in a mated arrangement with a joint 208 therebetween. When coupled to the conveyance tubing string 202 and mated as shown, the uphole and downhole components 204, 206 of the flanged connector 200 form part of the flow path of the conveyance tubing string 202. A sealing element (not visible) may be located between the uphole component 204 and the downhole component 206 to seal the joint 208 and to thereby prevent a leakage of well fluid in the conveyance tubing string 202 through the connector 200. In some examples, the sealing element may be a an O-ring. In other examples, the joint 208 may be sealed by metal-to-metal contact of the uphole and downhole components 204, 206, or by another sealing mechanism. In this example, the uphole component 204 more particularly includes a lower flange 210 that mates with an uphole face of the downhole component 206 to form the joint 208. The uphole component 204 can be secured to the downhole component 206 by a plurality of threaded fasteners 212 that pass through the lower flange 210 of the uphole component 204 and thread into the downhole component 206.

The uphole component 204 can also includes a central conduit 214 that extends in an uphole direction from the lower flange 210. As shown, the central conduit 214 may have a diameter that is smaller than the diameter of the lower flange 210, such that a circumferential recess 216 is formed in the uphole component 204. In other examples, the recess 216 may be added to (e.g., machined into) the uphole component 204. Thus, in some examples, the recess 216 may not extend over the entire circumference of the uphole component 204. The recess 216 may have a radial depth D and an axial length L, which can vary in magnitude in different examples of the uphole component 204. The length L of the recess 216 may be bounded by, for example, a shoulder 218 at an uphole end and at a downhole end by for example, fastener heads 212*a*, an uphole face of the lower flange 210, or a lower shoulder. In any case, the recess 216 has a finite axial length L and a physical upper and lower boundary. In other examples, the recess 216 may be replaced by a series of slots or other cavities having some radial depth and axial length and arranged at various locations along a circumference of the uphole component 204.

The downhole component 206 may include a groove 220, a slot, or a similar structure in an outer surface thereof. In some examples, the groove 220 may be inherently present in the downhole component 206. In other examples, the groove 220 may be added to (e.g., machined into) the downhole component 206. In some examples, the groove 220 may extend around the entire circumference of the outer surface of the downhole component 206. In other examples, the groove 220 may be multiple separated grooves located in only certain areas along the circumference of the outer surface of the downhole component 206.

Other connectors may be substituted for the flanged connector 200 in other examples. For example, as mentioned above, a connector may instead be a head-to-head connector, a base-to-base connector, or a threaded connector. In any case, such other connector types may also include an uphole component and a downhole component that each includes a recess, groove, slot or other similar features to those described above.

Figure 3:
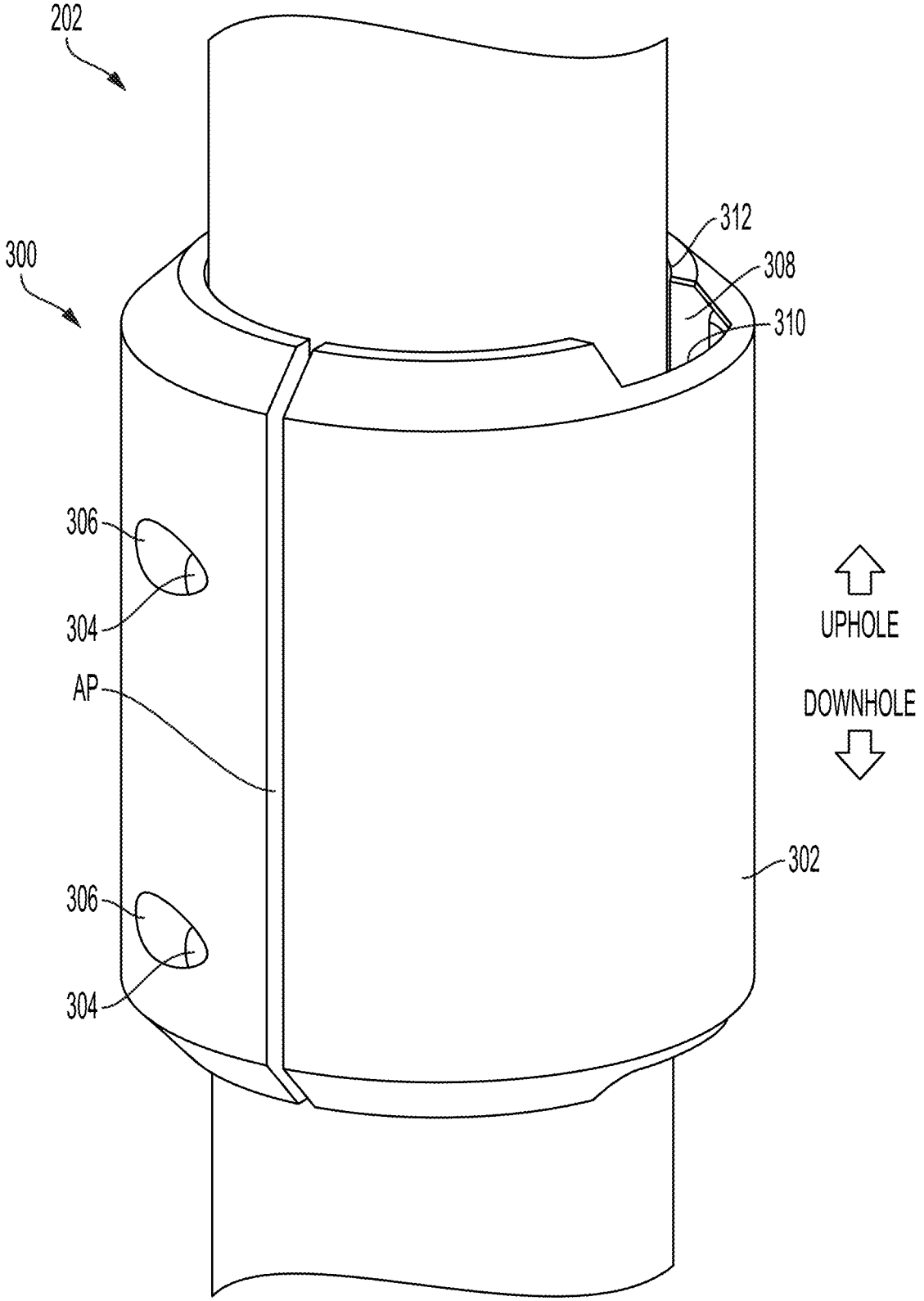
FIG. 3 is an isometric view of a coupling device installed over the flanged connector of the conveyance tubing string of FIG. 2 according to one example of the present disclosure.

FIG. 3 is an isometric view of a coupling device 300 installed over a conveyance tubing string connector according to one example of the present disclosure. In this example, the connector is the flanged connector 200 of the conveyance tubing string 202 of FIG. 2, but the coupling device 300 can also be installed to other types of connectors.

The coupling device 300 may include a sleeve member 302. The sleeve member 302 can encircle or partially encircle the flanged connector 200 and can span the joint 208 between the uphole component 204 and the downhole component 206 of the flanged connector 200. In some examples, the sleeve member 302 may be a split sleeve member. For example, the sleeve member 302 may be split into two halves along an axial plane AP. The two halves of the sleeve member 302 can each be installed over a respective portion of the flanged connector 200, as shown. The two halves of the sleeve member 302 may be subsequently secured to one another, such as by passing one or more threaded fasteners 304 through holes 306 in one half of the sleeve member 302 and threading the threaded fasteners 304 into the other half of the sleeve member 302. In some examples, it may be possible for such a split sleeve member 302 to utilize a hinged connection to allow the sleeve member 302 to be opened and closed during installation of the sleeve member 302 over the flanged connector 200.

As shown, the sleeve member 302 may also include a cable passageway 308 that is formed by an axial slot 310 in an inside wall 312 of the sleeve member 302. The cable passageway 308 can allow power, communications, or other types of cables to pass through the installed sleeve member 302 in order to reach equipment located further downhole. In some examples, the sleeve member 302 may have an outer diameter that is close to an inside diameter of a wellbore or a wellbore casing within which it is installed, such that the sleeve member 302 can also serve as a centering element that helps to center the conveyance tubing string 202 in the wellbore or wellbore casing.

Figure 4:
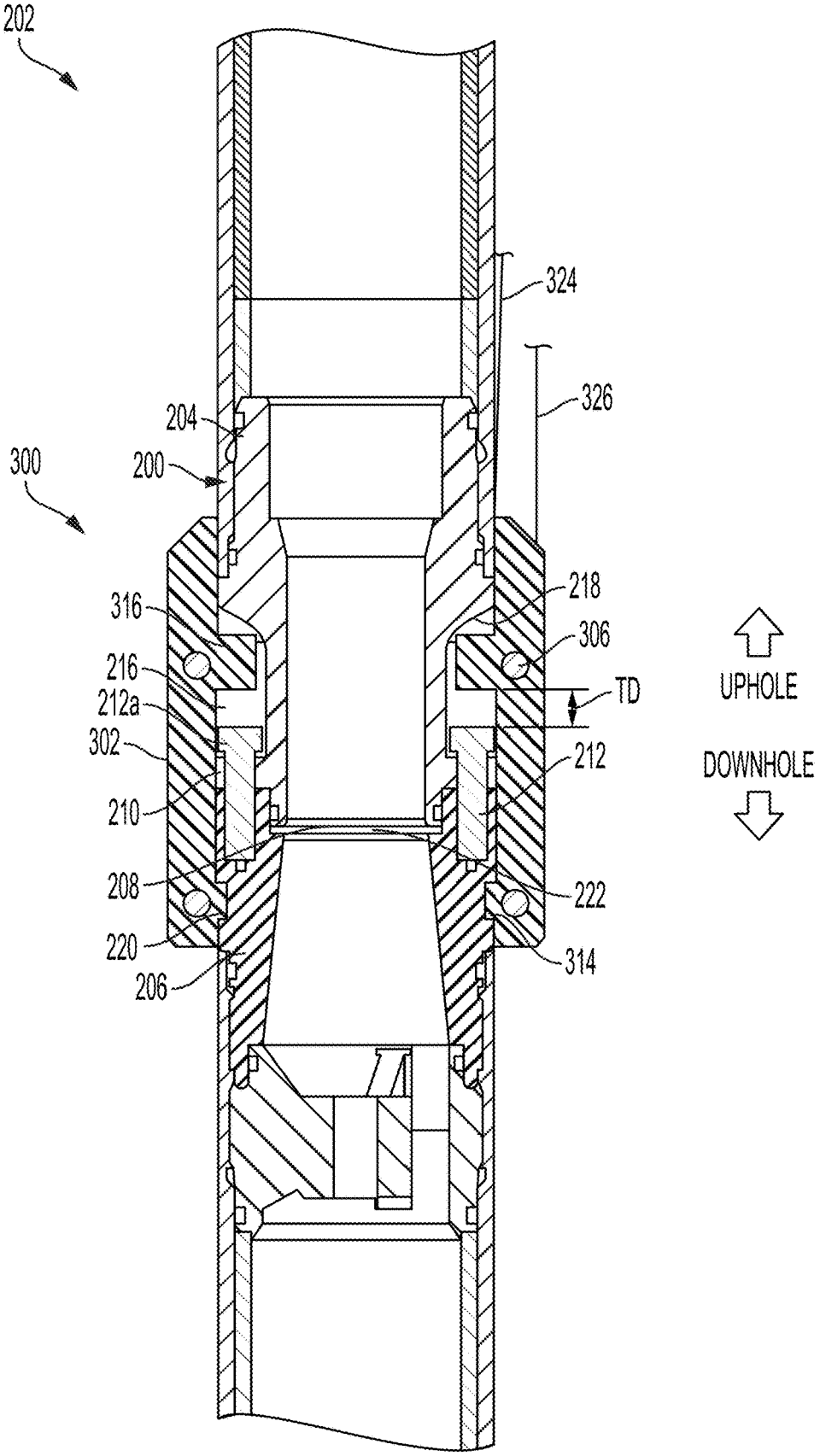
FIG. 4 is a cross-sectional view of the coupling device installed over the flanged connector of the conveyance tubing string of FIG. 2 according to one example of the present disclosure.

FIG. 4 is a cross-sectional view of the coupling device 300 installed over the flanged connector 200 of the conveyance tubing string 202 of FIG. 2 according to one example of the present disclosure. As shown, the uphole component 204 is secured to the downhole component 206 of the flanged connector 200 by the plurality of threaded fasteners 212, such that the joint 208 therebetween is pulled tightly together. As previously described, a metal-to-metal seal may be used to prevent a leak of well fluid through the flanged connector 200 in some examples. In this example, a seal 222 such as an O-ring is provided for that purpose.

The position of the coupling device 300 relative to the flanged connector 200 when the uphole component 204 and the downhole component 206 of the flanged connector 200 are secured to one another is also shown in FIG. 4. As may be further observed, the sleeve member 302 of the coupling device 300 can include a first flange 314 that protrudes radially inwardly from the inside wall 312 of the sleeve member 302 and is arranged to engage the groove 220 in the outer surface of the downhole component 206 of the flanged connector 200. The sleeve member 302 can also include a second flange 316 that protrudes radially inwardly from the inside wall 312 of the sleeve member 302 and is arranged on the sleeve member 302 to extend into the recess 216 in the uphole component 204 of the flanged connector 200.

An axial thickness of the second flange 316 of the sleeve member 302 is designed to be less than the axial length L of the recess 216 in the flanged connector 200. Consequently, the second flange 316 of the sleeve member 302 can move axially within the recess 216 during an axial movement of the coupling device 300 relative to the uphole component 204 of the flanged connector 200, which can result from a decoupling of the downhole component 206 of the flanged connector 200 from the uphole component 204. In this example, uphole axial movement of the second flange 316 within the recess 216 is limited by the shoulder 218 of the flanged connector 200, while downhole axial movement of the second flange 316 within the recess 216 is limited by the heads 212*a* of the threaded fasteners 212 used to secure the uphole component 204 to the downhole component 206 of the flanged connector 200. If the heads 212*a* of the threaded fasteners 212 are, for example, recessed into the lower flange 210 of the uphole component 204, or the uphole component 204 and the downhole component 206 are secured to one another in a different manner, the downhole axial movement of the second flange 316 within the recess 216 may be limited by an element or a structure other than the heads 212*a* of the threaded fasteners 212. For example, the downhole axial movement of the second flange 316 within the recess 216 may instead be limited by an uphole face of the lower flange 210, a lower shoulder of the uphole component 204, a lower wall of the recess, or by some other element associated with or affixed to the uphole component 204 or the recess 216 thereof.

In this example of the coupling device 300 and the flanged connector 200, the maximum distance by which the second flange 316 may move in an axial downhole direction within the recess 216—and thus the maximum distance by which the coupling device 300 may move in an axial downhole direction relative to the uphole component 204 of the flanged connector 200-is limited by the travel distance TD between a downhole face of the second flange 316 and the heads 212*a* of the threaded fasteners 212. That is, the heads 212*a* of the threaded fasteners 212 act as a hard stop to axial downhole movement of the second flange 316 and the coupling device 300. The travel distance TD is also the maximum distance by which the downhole component 206 of the flanged connector 200 (and the downhole portion of the conveyance tubing string 202 connected thereto) can become axially separated from the uphole component 204 of the flanged connector 200 upon an unintended decoupling of the flanged connector 200 (e.g., due to breakage of the threaded fasteners 212).

Figure 5:
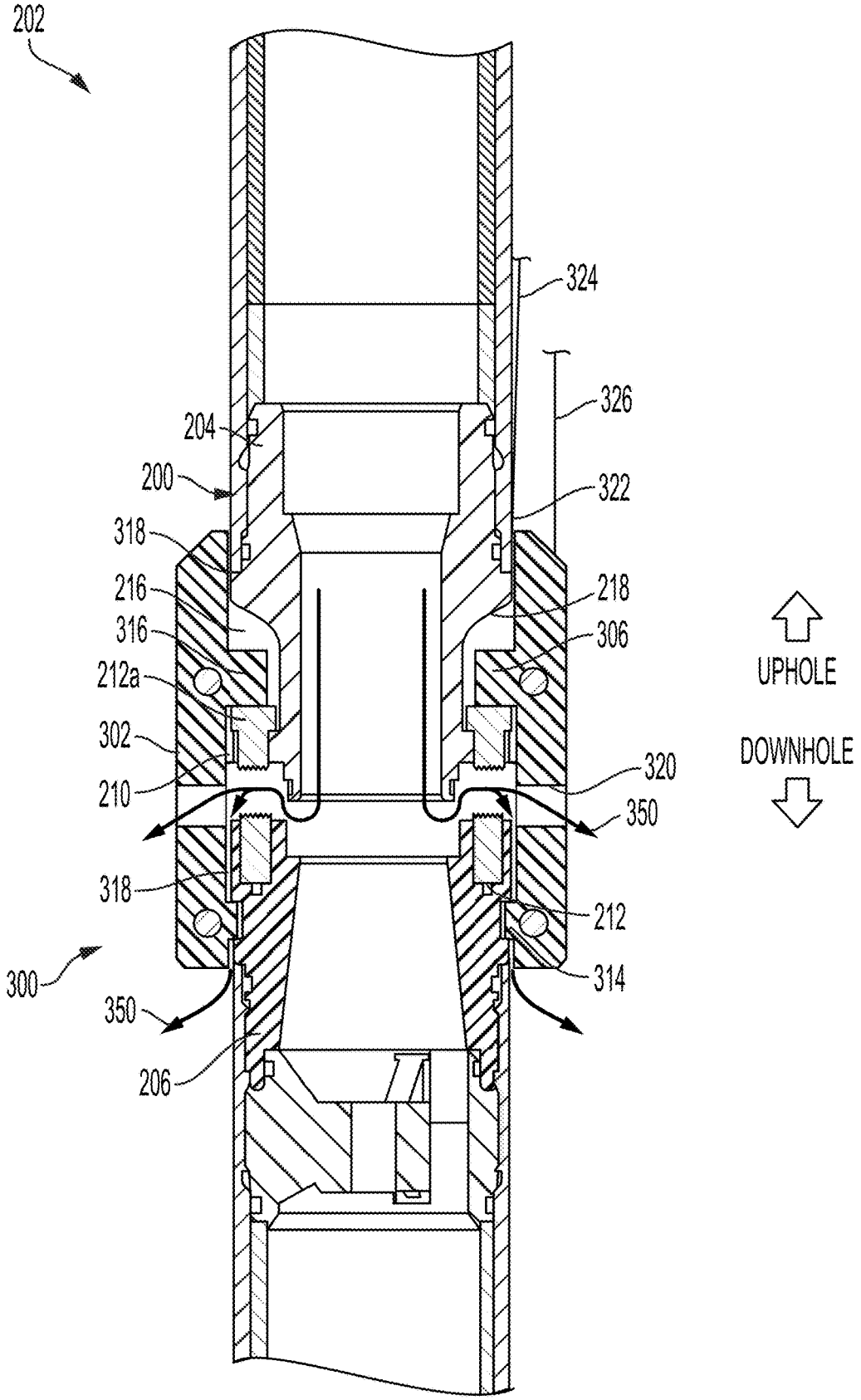
FIG. 5 is another cross-sectional view of the coupling device installed over the flanged connector of the conveyance tubing string of FIG. 2 according to one example of the present disclosure.

FIG. 5 is another cross-sectional view of the coupling device installed over the flanged connector of the conveyance tubing string of FIG. 2 according to one example of the present disclosure. The relationship of the uphole component 204 to the downhole component 206 of the flanged connector 200 and the relationship of the coupling device 300 to the flanged connector 200 after an unintended decoupling of the flanged connector 200 may be observed in FIG. 5. In this example, the unintended decoupling of the flanged connector 200 results from a breaking of the threaded fasteners 212 of the flanged connector. In an example, the threaded fasteners 212 may break as a result of shear forces or torsional forces applied to the threaded fasteners 212, or to defects in the material or the manufacture of the threaded fasteners 212. When such an unintended decoupling of the flanged connector 200 occurs, the downhole component 206 of the flanged connector 200 and the downhole portion of the conveyance tubing string 202 coupled thereto may fall to a greater depth within the wellbore. This may necessitate a subsequent retrieval operation and possible replacement of conveyance tubing string 202 components or other downhole components, or repairs to the well. As depicted in FIG. 5, the presence of the coupling device 300 may prevent such a downhole loss of the downhole component 206 of the flanged connector 200 and the downhole portion of the conveyance tubing string 202 coupled thereto.

With the coupling device 300 installed to the flanged connector 200, it can be observed in FIG. 5 that downhole movement of the downhole component 206 of the flanged connector 200 and the downhole portion of the conveyance tubing string 202 coupled thereto is limited upon an unintended decoupling of the flanged connector 200. Particularly, the coupling device 300 causes the downhole component 206 of the flanged connector 200 to remain coupled to the uphole component 204 of the flanged connector 200 in a suspended manner upon an unintended decoupling of the flanged connector 200. As such, the downhole component 206 of the flanged connector 200 and the downhole portion of the conveyance tubing string 202 coupled thereto can be extracted from the wellbore by lifting the uphole portion of the conveyance tubing string 202 that is coupled to the uphole component 204 of the flanged connector 200.

The manner in which the coupling device 300 operates upon an unintended decoupling of the flanged connector 200 may also be more clearly observed in FIG. 5. As shown, when the threaded fasteners 212 of the flanged connector 200 break, the downhole component 206 of the flanged connector 200 is permitted to separate from the uphole component 204 of the flanged connector 200. The downhole component 206 and the downhole portion of the conveyance tubing string 202 coupled thereto are thus allowed to move downhole, but only by a predetermined distance. In this example, the predetermined distance by which the downhole component 206 and the downhole portion of the conveyance tubing string 202 coupled thereto may move in a downhole direction is equal to the second flange 316 travel distance TD of FIG. 4.

More specifically, upon the depicted unintended decoupling of the flanged connector 200 due to breakage of the threaded fasteners 212, the coupling device 300 will move downhole relative to the uphole component 204 of the flanged connector 200 along with the downhole component 206 of the flanged connector 200 due to the engagement of the first flange 314 of the sleeve member with the groove 220 in the downhole component 206. The second flange 316 of the sleeve member 302 of the coupling device 300 will consequently move in a downhole direction within the recess 216 of the uphole component 204 of the flanged connector 200 until the second flange 316 and the sleeve member 302 reach a hard stopped position. In this example, the hard stopped position occurs when a downhole face of the second flange 316 of the sleeve member 302 contacts the heads 212*a* of the threaded fasteners 212. That is, the contact between the second flange 316 of the sleeve member 302 and the heads 212*a* of the threaded fasteners 212 acts as a hard stop to further downhole movement of the second flange 316 and the sleeve member 302, and consequently, to further downhole movement of the coupling device 300. As the downhole component 206 remains coupled to the coupling device 300 by engagement of the first flange 314 with the groove 220 in the downhole component 206, and the downhole portion of the conveyance tubing string 202 remains coupled to the downhole component 206, further downhole movement of the downhole component 206 and the portion of the conveyance tubing string 202 coupled thereto is also prevented.

As further represented in FIG. 5, enabling the downhole component 206 of the flanged connector 200 to separate and move axially away from the uphole component 204 of the flanged connector 200 by a limited distance upon an unintended decoupling of the flanged connector 200 can also enable well fluids 350 present within the conveyance tubing string 202 to drain into an annulus of the wellbore in which the conveyance tubing string 202 is located. Draining the well fluid can substantially reduce the weight of the conveyance tubing string 202, which facilitates retrieval of the conveyance tubing string 202 to the well surface to repair or replace the flanged connector 200. Draining the well fluid can also relieve internal pressure from within the conveyance tubing string 202 prior to withdrawing the conveyance tubing string 202 from the wellbore.

In some examples, well fluid can drain from the conveyance tubing string 202 into the well annulus through one or more gaps 318 between the inside wall 312 of the sleeve member 302 of the coupling device 300 and an outside surface of the flanged connector 200. Additionally, or in lieu of well fluid drainage through the one or more gaps 318, well fluid may also drain into the well annulus through one or more fluid passageways 320 that may extend from the inside wall 312 through an outside wall of the sleeve member 302.

In some examples, a downhole movement of the coupling device 300 relative to the uphole component 204 of the flanged connector 200 may be used to indicate an unintended decoupling of the flanged connector 200. For example, a sensor 322 such as a limit switch, a proximity sensor, a load cell, etc., may be installed to the uphole component 204 of the flanged connector 200 or the sleeve member 302 of the coupling device 300 so as to be triggered upon downhole movement of the coupling device 300 relative to the uphole component 204. The sensor 322 may generate a signal in response to this downhole movement of the uphole component 204 of the flanged connector 200. The signal may be carried by a communication cable 324 or otherwise wirelessly transmitted to receiving equipment at the well surface to indicate an unintended decoupling of the flanged connector 200. In another more rudimentary example, a cable 326 may be affixed to the sleeve member 302 of the coupling device 300 such that the cable is pulled in a downhole direction upon an unintended decoupling of the flanged connector 200 by a downhole movement of the coupling device 300 relative to the uphole component 204 of the flanged connector 200. A resulting tension produced in the cable 326 may activate a device (e.g., an audible and/or visual indicator device) to indicate an unintended decoupling of the flanged connector 200. In either case, after an indication of a failed flanged connector 200, conveyance of well fluid to the well surface may be halted and the conveyance tubing string 202 may be raised to the well surface at least to a point where the failed flanged connector 200 can be repaired or replaced.

Figure 6:
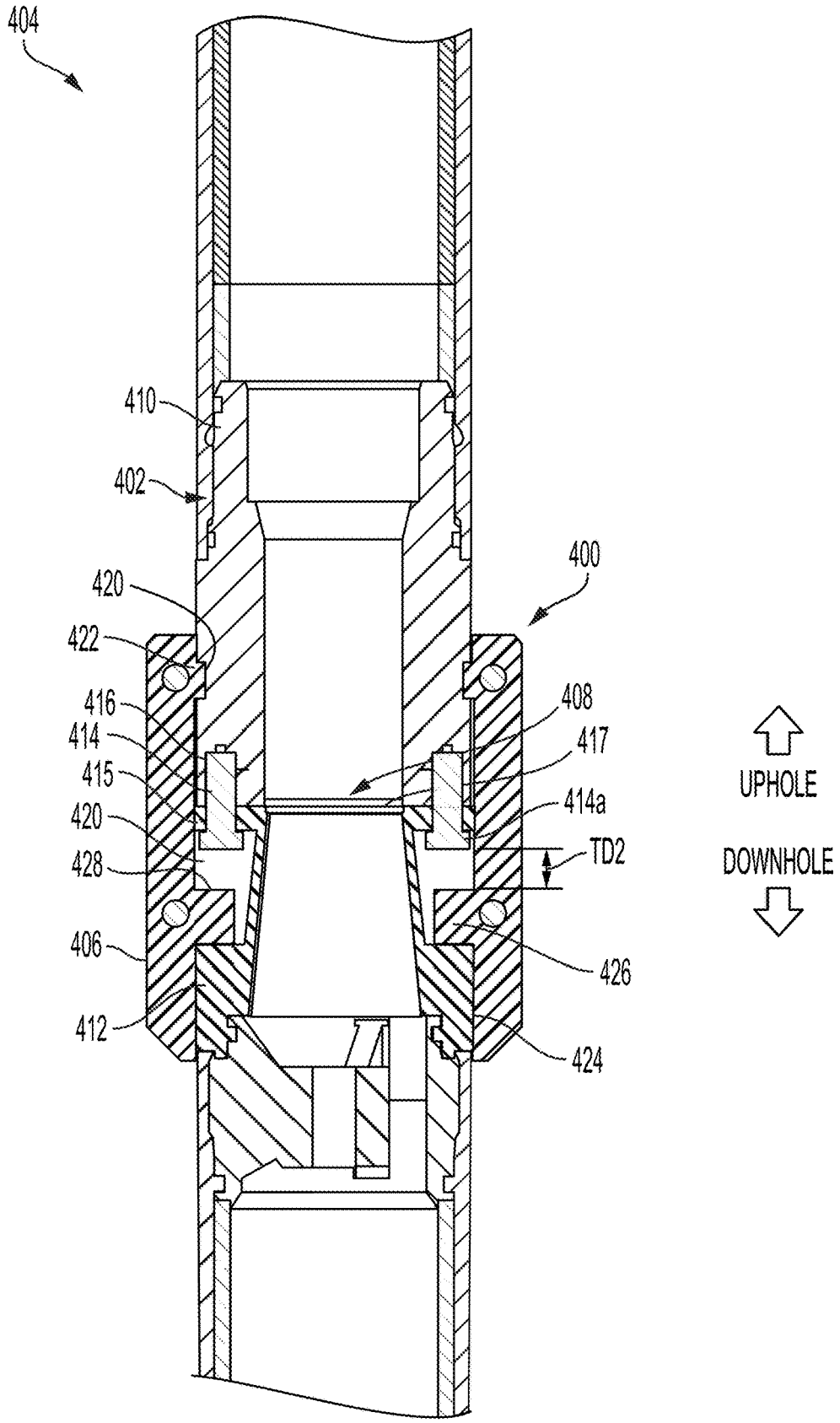
FIG. 6 is a cross-sectional view of another coupling device installed over a flanged connector of another conveyance tubing string according to another example of the present disclosure.

FIG. 6 is a cross-sectional view of another coupling device 400 installed over a flanged connector 402 of another conveyance tubing string 404 according to another example of the present disclosure. In some examples, the coupling device 400 may be the coupling device 300 of FIGS. 3-5 installed to the flanged connector 402 in an inverted uphole-downhole orientation relative to the orientation shown in FIGS. 3-5. In any case, the coupling device 400 can include a sleeve member 406, which can encircle or partially encircle the flanged connector 402 and can span a joint 408 between an uphole component 410 and a downhole component 412 of the flanged connector 402. The sleeve member 406 may utilize any of the designs or constructions described above with respect to the sleeve member 302 of FIGS. 3-5, including but not limited to having a split sleeve construction or a cable passageway. A decoupling detection sensor may also installed between the coupling device 400 and the downhole component 412 of the flanged connector 402, or between the uphole component 410 and the downhole component 412 of the flanged connector 402.

In the example of FIG. 6, the downhole component 412 is secured to the uphole component 410 of the flanged connector 402 by a plurality of threaded fasteners 414 that pass upward through a coupling flange 415 at the uphole end of the downhole component 412 and into threaded holes 416 in the uphole component 410, such that the joint 408 between the uphole component 410 and the downhole component 412 is pulled tightly together. A metal-to-metal seal or a seal 417 such as an O-ring may be used to prevent a leak of well fluid through the flanged connector 402 in some examples.

As can be observed in FIG. 6, the uphole component 410 of the flanged connector 402 includes a groove 418 in an outer surface thereof and the downhole component 412 of the flanged connector 402 includes a recess 420. This is in contrast to the flanged connector 200 illustrated in FIGS. 2 and 4-5, where the uphole component 204 includes the recess 216 and the downhole component 206 includes the groove 220. The sleeve member 406 can thus include a first flange 422 that protrudes radially inwardly from an inside wall 424 of the sleeve member 406 and is arranged on the sleeve member 406 to extend into and engage the groove 418 in the uphole component 410 of the flanged connector 402. Likewise, the sleeve member 406 can also include a second flange 426 that protrudes radially inwardly from the inside wall 424 of the sleeve member 406 and is arranged on the sleeve member 406 to extend into the recess 420 in the downhole component 412 of the flanged connector 402.

An axial thickness of the coupling flange 415 of the downhole component 412 of the sleeve member 406 is designed to be less than an axial length of the recess 420 in the flanged connector 402. Consequently, the coupling flange 415 of the downhole component 412 can move axially within the recess 420 during a downhole movement of the downhole component 412 resulting from an unintentional decoupling of the downhole component 412 from the uphole component 410. Because the sleeve member 406 is coupled to the uphole component 410 by engagement between the first flange 422 of the sleeve member 406 and the groove 418 in the uphole component 410, the coupling device 400 does not move downhole upon a decoupling of the downhole component 412 from the uphole component 410 of the flanged connector 402. Thus, in this example, downhole axial movement of the coupling flange 415 within the recess 420 is limited by contact between heads 414*a* of the threaded fasteners 414 with an uphole face 428 of the second flange 426 of the sleeve member 406. If the heads 414*a* of the threaded fasteners 414 are, for example, recessed into the coupling flange 415 of the downhole component 412, or the uphole component 410 and the downhole component 412 are secured to one another in a different manner, the downhole axial movement of the coupling flange 415 within the recess 420 may be limited by an element or a structure other than the heads 414*a* of the threaded fasteners 414. For example, the downhole axial movement of the coupling flange 415 within the recess 420 may instead be limited by contact between a downhole face of the coupling flange 415 of the downhole component 412 and the uphole face 428 of the second flange 426 of the sleeve member 406.

In this example of the coupling device 400 and the flanged connector 402, the maximum distance by which the coupling flange 415 may move in an axial downhole direction within the recess 420—and thus the maximum distance by which the downhole component 412 may move in an axial downhole direction relative to the uphole component 410 of the flanged connector 402-is limited by the travel distance TD2 between the uphole face 428 of the second flange 426 and the heads 414*a* of the threaded fasteners 414. The travel distance TD2 is also the maximum distance by which the downhole component 412 of the flanged connector 402 (and the downhole portion of the conveyance tubing string 404 connected thereto) can become axially separated from the uphole component 410 of the flanged connector 402 upon an unintended decoupling of the flanged connector 402 (e.g., due to breakage of the threaded fasteners 414).

Figure 7:
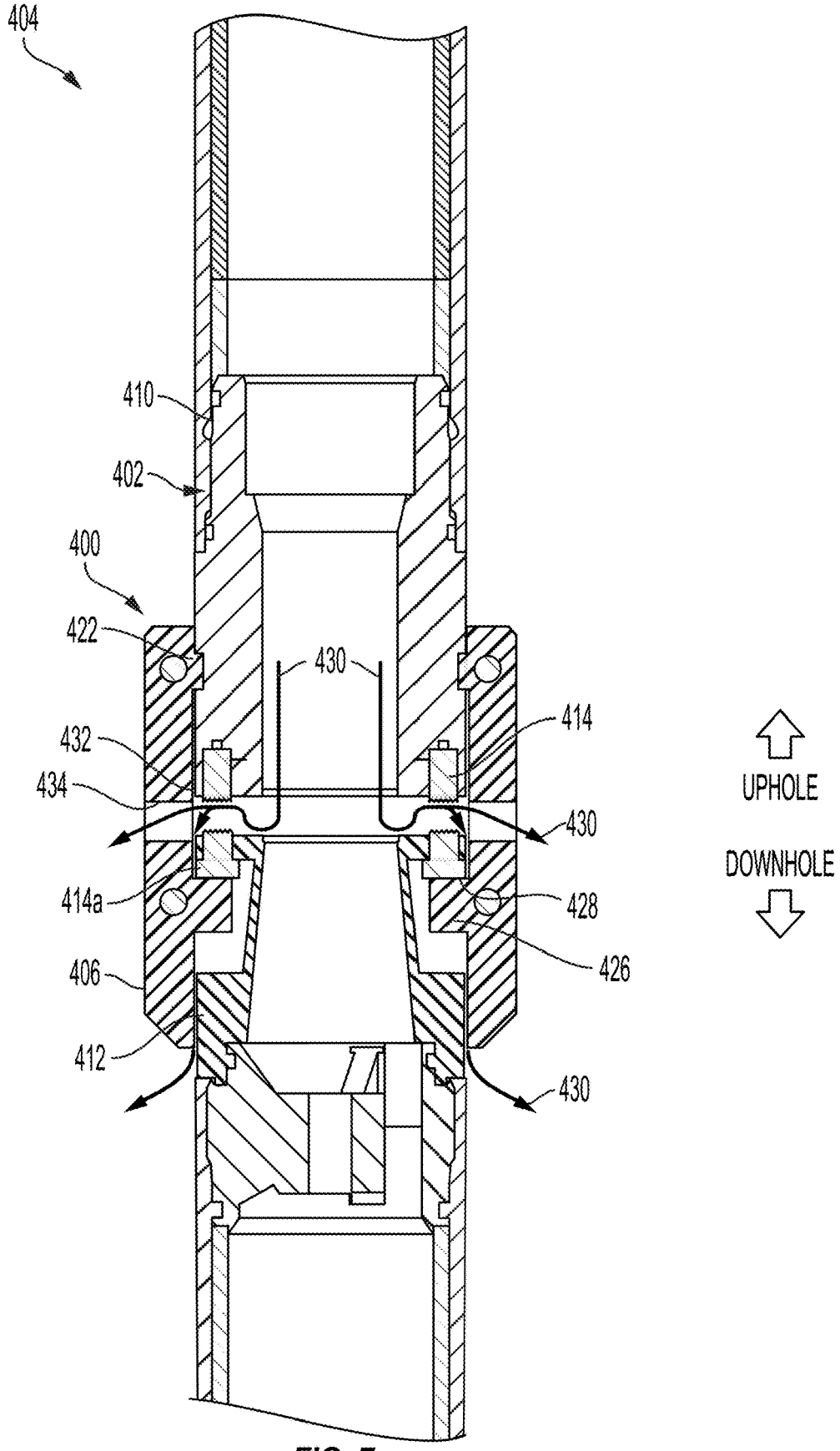
FIG. 7 is another cross-sectional view of the coupling device installed over the flanged connector of the conveyance tubing string of FIG. 6 according to one example of the present disclosure.

FIG. 7 is another cross-sectional view of the coupling device installed over the flanged connector of the conveyance tubing string 404 of FIG. 6 according to one example of the present disclosure. Particularly, FIG. 7 illustrates the operation of the coupling device 400 during an unintentional decoupling of the downhole component 412 from the uphole component 410 of the flanged connector 402. In this example, the unintended decoupling of the flanged connector 402 results from a breaking of the threaded fasteners 414 of the flanged connector. As depicted in FIG. 7, the presence of the coupling device 400 can prevent a downhole loss of the downhole component 412 of the flanged connector 402 and the downhole portion of the conveyance tubing string 404 coupled thereto upon an unintended decoupling of the flanged connector 402.

With the coupling device 400 installed to the flanged connector 402 as shown in FIG. 7, it can be understood that downhole movement of the downhole component 412 of the flanged connector 402 and the downhole portion of the conveyance tubing string 404 coupled thereto is limited upon an unintended decoupling of the flanged connector 402. Particularly, the presence of the coupling device 400 causes the downhole component 412 of the flanged connector 402 to remain coupled to the uphole component 410 of the flanged connector 402 in a suspended manner upon an unintended decoupling of the flanged connector 402.

When, for example, the threaded fasteners 414 of the flanged connector 402 break, the downhole component 412 of the flanged connector 402 is permitted to separate from the uphole component 410 of the flanged connector 402. The downhole component 412 and the downhole portion of the conveyance tubing string 404 coupled thereto are thus allowed to move downhole, but only by a predetermined distance. In this example, the predetermined distance by which the downhole component 412 and the downhole portion of the conveyance tubing string 404 coupled thereto may move in a downhole direction is equal to the travel distance TD2 of the coupling flange 415 (see FIG. 6).

More specifically, upon the depicted unintended decoupling of the flanged connector 402 due to breakage of the threaded fasteners 414, the downhole component 412 of the flanged connector 402 will move downhole relative to the uphole component 410 of the flanged connector 402, and also relative to the sleeve member 406 due to the stationary position of the sleeve member resulting from engagement of the first flange 422 of the sleeve member with the groove 418 in the uphole component 410. The coupling flange 415 of the downhole component 412 of the flanged connector 402 will consequently move in a downhole direction within the recess 420 in the sleeve member 406 until the fastener heads 414*a* (or the coupling flange 415) contact the uphole face 428 of the second flange 426 of the sleeve member 406. The downhole component 412 remains coupled to the coupling device 400 and the coupling device 400 remains coupled to the uphole component 410 by way of engagement of the first flange 422 with the groove 418 in the uphole component 410. Likewise, the downhole portion of the conveyance tubing string 404 remains coupled to the downhole component 412. Thus, a downhole loss of the portion of the conveyance tubing string 404 coupled to the downhole component 412 can be prevented.

As was the case with respect to use of the coupling device 300 of FIGS. 3-5, enabling the downhole component 412 of the flanged connector 402 to separate and move axially away from the uphole component 410 of the flanged connector 402 by a limited distance upon an unintended decoupling of the flanged connector 402 can also enable well fluids 430 present within the conveyance tubing string 404 to drain into an annulus of the wellbore in which the conveyance tubing string 404 is located. This desirable for at least the purposes previously described. As represented in FIG. 7, well fluid may drain from the conveyance tubing string 404 into the well annulus via one or more fluid paths. For example, the well fluid may drain through one or more gaps 432 between the inside wall 424 of the sleeve member 406 of the coupling device 400 and an outside surface of the flanged connector 402. Additionally, or in lieu of well fluid drainage through the one or more gaps 432, well fluid may also from drain the conveyance tubing string 404 into the well annulus through one or more fluid passageways 434 that may extend from the inside wall 424 through an outside wall of the sleeve member 406.

Figure 8:
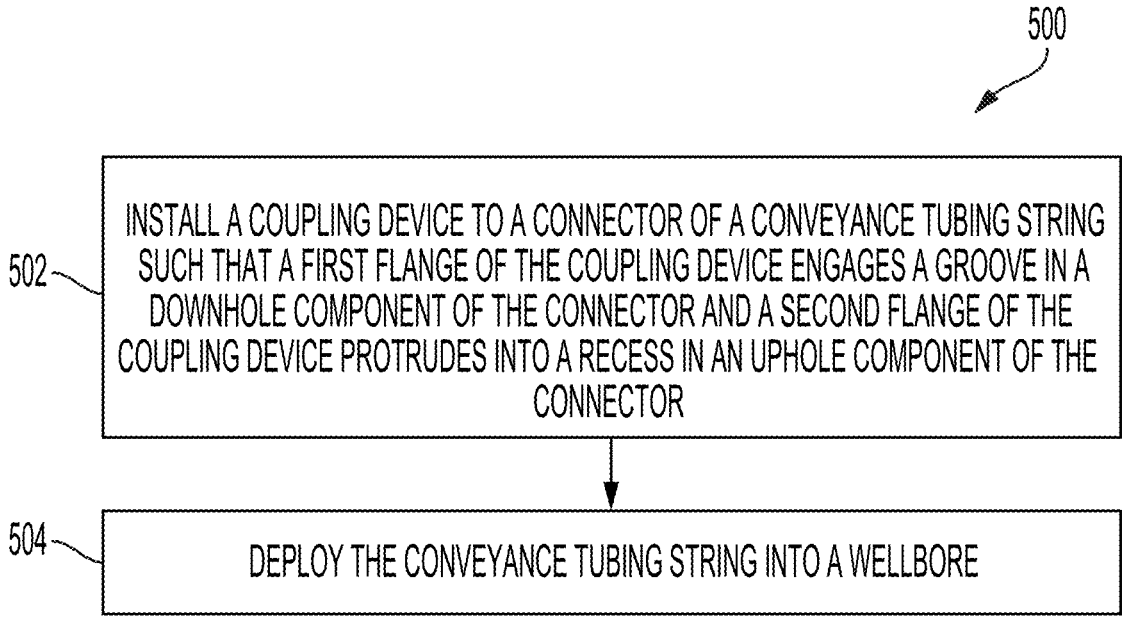
FIG. 8 is a flowchart illustrating a method of preventing a downhole loss of a portion of a conveyance tubing string upon an unintended decoupling of a connector according to one example of the present disclosure.

FIG. 8 is a flowchart 500 illustrating a method of preventing the loss of a downhole portion of a conveyance tubing string upon an unintended decoupling of a connector according to one example of the present disclosure.

As represented in block 502 of the flowchart 500, a coupling device is installed to a connector of a conveyance tubing string. The connector can include an uphole component and a downhole component. The uphole component and the downhole component of the connector may be arranged in mating contact along a joint therebetween. The mating contact may be sealing contact, or a sealing element such as an O-ring may be used to ensure sealing of the joint. A fluid passageway is thus formed through the connector.

The coupling device may include a sleeve member that at least partially encircles the connector and spans the joint between the uphole component and the downhole component of the connector. The sleeve member may include a first flange that, according to some examples, protrudes radially inwardly from the inside wall of the sleeve member and engages a groove in the downhole component of the connector. The sleeve member may also include a second flange that, according to some examples, protrudes radially inwardly from an inside wall of the sleeve member and into a recess in the uphole component of the connector.

As represented in block 504 of the flowchart 500, the conveyance tubing string, with the coupling device installed thereto, can then be deployed downhole in a wellbore. In some examples, the wellbore may be a wellbore of a hydrocarbon well. In some examples, the hydrocarbon well may be a completed well and the conveyance tubing string may be a production tubing string.

In the event of an unintended decoupling of the connector of the deployed conveyance tubing string, such as due to a failure of the threaded fasteners of a flanged connector, an axial separation of the downhole component of the connector from the uphole component of the connector along the joint therebetween will take place. The distance by which the downhole component of the connector can separate from the uphole component of the connector is limitable by a restricted axial movement of the second flange of the sleeve member of the coupling device within the recess in the uphole component of the connector. For example, the second flange of the connector may contact the heads of fasteners used to secure the uphole component to the downhole component, an uphole face of a flange of the uphole component, another bottom wall of the recess or some other element or structure located in the recess.

A limited separation of the uphole component of the connector from the downhole component of the connector will expose the interior of the conveyance tubing string and well fluid located therein. In such a case, at least some of the well fluid located within the conveyance tubing string can drain therefrom through a gap between the coupling device and an outside surface of the connector in some examples. In other examples, at least some of the well fluid located within the conveyance tubing string can instead or additionally drain therefrom through one or more fluid passageways that pass through the coupling device. Draining the well fluid in this manner can reduce pressure within the conveyance tubing string, and can also reduce the weight of the conveyance tubing string, which can help to facilitate a raising of the conveyance tubing string to repair or replace the failed connector.

It should be understood that a coupling device according to the present disclosure is equally applicable to wellbore conveyances other than production tubing strings, including without limitation, pipe, casing, liners, jointed tubing, coiled tubing, etc. It should also be understood that while the use of a flanged connector is described above for purposes of illustrating examples of a coupling device according to the present disclosure, the flanged connector may be replaced with another type of connector in other examples. For example, and without limitation, connectors such as head-to-head connectors, base-to-base connectors, or threaded connectors may be used in conveyance tubing strings in other examples, and a coupling device as shown and described herein may operate equally well with such connectors to prevent conveyance tubing string loss upon an unintended decoupling of a connector.

Use of a coupling device according to the present disclosure can eliminate or reduce costs typically associated with an unintended decoupling of a conveyance tubing string connector. For example, preventing the downhole loss of a tubing string upon an unintended decoupling of a connector can eliminate the cost associated with retrieving a fallen tubing string from possibly deep within a wellbore. Likewise, preventing the downhole loss of a tubing string upon an unintended decoupling of a connector can eliminate the cost associated with lost well production time, damage to components of the fallen tubing string, and/or damage to the wellbore, a wellbore casing, or other downhole well equipment resulting from the fallen tubing string.

In some aspects, coupling device, a wellbore conveyance tubing string connector assembly, and a method for preventing the downhole loss of a portion of a tubing string upon an unintended decoupling of a connector, are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a coupling device, including a sleeve member positionable to at least partially encircle a connector of a wellbore conveyance tubing string and to span a joint between an uphole component and a downhole component of the connector. The coupling device also includes a first flange protruding radially inwardly from an inside wall of the sleeve member and arranged to engage at least one groove in the downhole component of the connector, and a second flange protruding radially inwardly from the inside wall of the sleeve member and extendable into a recess in the uphole component of the connector to limit a distance of an axial separation of the downhole component of the connector from the uphole component of the connector.

Example 2 is the coupling device of example 1, wherein the connector is a flanged connector and the uphole component of the flanged connector is securable to the downhole component of the flanged connector by a plurality of threaded fasteners.

Example 3 is the coupling device of example 1 or example 2, wherein the sleeve member comprises two halves that are installable over the connector and subsequently securable to one another.

Example 4 is the coupling device of example 1, wherein the second flange of the sleeve member is positionable to contact a stop element at or near a downhole terminus of the recess in the uphole component to restrict a downhole axial movement of the second flange within the recess in the uphole component of the connector.

Example 5 is the coupling device of example 4, wherein the connector is a flanged connector, and the stop element is an uphole face of a connecting flange of the uphole component or one or more heads of a plurality of threaded fasteners that secure the uphole component to the downhole component.

Example 6 is the coupling device of any of examples 1-5, further comprising a cable passageway slot that extends axially along the inside wall of the sleeve member.

Example 7 is the coupling device of any of examples 1-6, further comprising one or more fluid passageways extending from the inside wall through an outside wall of the sleeve member.

Example 8 is a coupling device including a sleeve member positionable to at least partially encircle a connector of a wellbore conveyance tubing string and to span a joint between an uphole component and a downhole component of the connector. The coupling device also includes a first flange protruding radially inwardly from an inside wall of the sleeve member and arranged to engage at least one groove in the uphole component of the connector, and a second flange protruding radially inwardly from the inside wall of the sleeve member and extendable into a recess in the downhole component of the connector to limit a distance of an axial separation of the downhole component of the connector from the uphole component of the connector.

Example 9 is the coupling device of example 8, wherein the connector is a flanged connector and the uphole component of the flanged connector is securable to the downhole component of the flanged connector by a plurality of threaded fasteners.

Example 10 is the coupling device of example 9, wherein a coupling flange of the downhole component of the flanged connector is positionable within the recess in the downhole component to restrict a downhole axial movement of the downhole component of the flanged connector relative to the uphole component of the flanged connector and to the sleeve member.

Example 11 is the coupling device of example 10, wherein an uphole face of the second flange of the sleeve member acts as a stop element to downhole movement of the coupling flange of the downhole component of the flanged connector within the sleeve member.

Example 12 is the coupling device of any of examples 8-11, wherein the sleeve member comprises two halves that are installable over the connector and subsequently securable to one another.

Example 13 is the coupling device of any of examples 8-11, further comprising one or more fluid passageways extending from the inside wall through an outside wall of the sleeve member.

Example 14 is the coupling device of any of examples 8-11, further comprising a cable passageway slot that extends axially along the inside wall of the sleeve member.

Example 15 is a method including installing a coupling device to a connector of a conveyance tubing string, the connector having an uphole component and a downhole component arranged in mating contact along a joint therebetween. According to the method, the coupling device includes a sleeve member at least partially encircling the connector and spanning the joint between the uphole component and the downhole component of the connector. The coupling device also includes a first flange that protrudes radially inwardly from an inside wall of the sleeve member and into a groove in the downhole component of the connector, and a second flange that protrudes radially inwardly from the inside wall of the sleeve member and extends into a recess in the uphole component of the connector to limit a distance of an axial separation of the downhole component of the connector from the uphole component of the connector; and deploying the conveyance tubing string downhole in a wellbore.

Example 16 is the method of example 15, wherein the sleeve member of the coupling device is installed to the connector in two halves that are subsequently secured to one another.

Example 17 is the method of example 15 or example 16, wherein well fluid located within the conveyance tubing string drains through a gap between the inside wall of the sleeve member of the coupling device and an outside surface of the connector when the downhole component of the connector becomes axially separated from the uphole component of the connector along the joint therebetween.

Example 18 is the method of any of examples 15-17, wherein well fluid located within the conveyance tubing string drains through one or more fluid passageways passing through the sleeve member of the coupling device when the downhole component of the connector becomes axially separated from the uphole component of the connector along the joint therebetween.

Example 19 is the method of any of examples 15-18, further including installing a sensor to the uphole component of the connector or to the sleeve member of the coupling device, and transmitting a signal, from the sensor to a well surface, that indicates an unintended decoupling of the connector when the coupling device moves in a downhole direction relative to the uphole component of the connector.

Example 20 is the method of examples 19, wherein receipt of the signal transmitted by the sensor triggers a cessation of a well fluid pumping operation and a subsequent withdrawal of at least a part of the conveyance tubing string from the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A coupling device, comprising:

a sleeve member positionable to at least partially encircle a connector of a wellbore conveyance tubing string and to span a joint between an uphole component and a downhole component of the connector, the sleeve member comprising at least two halves that are installable over the connector and subsequently securable to one another;

a first flange protruding radially inwardly from an inside wall of the sleeve member and arranged to engage at least one groove in the downhole component of the connector; and a second flange protruding radially inwardly from the inside wall of the sleeve member and extendable into a recess in the uphole component of the connector to limit a distance of an axial separation of the downhole component of the connector from the uphole component of the connector.

2. The coupling device of claim 1, wherein the connector is a flanged connector and the uphole component of the flanged connector is securable to the downhole component of the flanged connector by a plurality of threaded fasteners.

3. The coupling device of claim 1, wherein an axial thickness of the second flange of the sleeve member is less than an axial length of the recess in the uphole component of the connector so as to permit a limited axial movement of the second flange within the recess.

4. The coupling device of claim 1, wherein the second flange of the sleeve member is positionable to contact a stop element at or near a downhole terminus of the recess in the uphole component to restrict a downhole axial movement of the second flange within the recess in the uphole component of the connector.

5. The coupling device of claim 4, wherein the connector is a flanged connector, and the stop element is an uphole face of a connecting flange of the uphole component or one or more heads of a plurality of threaded fasteners that secure the uphole component to the downhole component.

6. The coupling device of claim 1, further comprising a cable passageway slot that extends axially along the inside wall of the sleeve member.

7. The coupling device of claim 1, further comprising one or more fluid passageways extending from the inside wall through an outside wall of the sleeve member.

8. A coupling device comprising:

a sleeve member positionable to at least partially encircle a connector of a wellbore conveyance tubing string and to span a joint between an uphole component and a downhole component of the connector, the sleeve member comprising at least two halves that are installable over the connector and subsequently securable to one another;

a first flange protruding radially inwardly from an inside wall of the sleeve member and arranged to engage at least one groove in the uphole component of the connector; and a second flange protruding radially inwardly from the inside wall of the sleeve member and extendable into a recess in the downhole component of the connector to limit a distance of an axial separation of the downhole component of the connector from the uphole component of the connector.

9. The coupling device of claim 8, wherein the connector is a flanged connector and the uphole component of the flanged connector is securable to the downhole component of the flanged connector by a plurality of threaded fasteners.

10. The coupling device of claim 9, wherein a coupling flange of the downhole component of the flanged connector is positionable within the recess in the downhole component to restrict a downhole axial movement of the downhole component of the flanged connector relative to the uphole component of the flanged connector and to the sleeve member.

11. The coupling device of claim 10, wherein an uphole face of the second flange of the sleeve member acts as a stop element to downhole movement of the coupling flange of the downhole component of the flanged connector within the sleeve member.

12. The coupling device of claim 8, wherein an axial thickness of the second flange of the sleeve member is less than an axial length of the recess in the downhole component of the connector so as to permit a limited axial movement of the second flange within the recess.

13. The coupling device of claim 8, further comprising one or more fluid passageways extending from the inside wall through an outside wall of the sleeve member.

14. The coupling device of claim 8, further comprising a cable passageway slot that extends axially along the inside wall of the sleeve member.

15. A method comprising:

installing a coupling device to a connector of a conveyance tubing string, the connector having an uphole component and a downhole component arranged in mating contact along a joint therebetween, the coupling device comprising:

a sleeve member at least partially encircling the connector and spanning the joint between the uphole component and the downhole component of the connector, the sleeve installed to the connector in at least two halves that are subsequently secured to one another a first flange that protrudes radially inwardly from an inside wall of the sleeve member and into a groove in the downhole component of the connector, and a second flange that protrudes radially inwardly from the inside wall of the sleeve member and extends into a recess in the uphole component of the connector to limit a distance of an axial separation of the downhole component of the connector from the uphole component of the connector; and deploying the conveyance tubing string downhole in a wellbore.

16. The method of claim 15, wherein an axial thickness of the second flange of the sleeve member of the coupling device is less than an axial length of the recess in the uphole component of the connector so as to permit a limited axial movement of the second flange within the recess.

17. The method of claim 15, wherein well fluid located within the conveyance tubing string drains through a gap between the inside wall of the sleeve member of the coupling device and an outside surface of the connector when the downhole component of the connector becomes axially separated from the uphole component of the connector along the joint therebetween.

18. The method of claim 15, wherein well fluid located within the conveyance tubing string drains through one or more fluid passageways passing through the sleeve member of the coupling device when the downhole component of the connector becomes axially separated from the uphole component of the connector along the joint therebetween.

19. The method of claim 15, further comprising:

installing a sensor to the uphole component of the connector or to the sleeve member of the coupling device; and transmitting a signal, from the sensor to a well surface, that indicates an unintended decoupling of the connector when the coupling device moves in a downhole direction relative to the uphole component of the connector.

20. The method of claim 19, wherein receipt of the signal transmitted by the sensor triggers a cessation of a well fluid pumping operation and a subsequent withdrawal of at least a part of the conveyance tubing string from the wellbore.

* * * * *